US006951381B2

(12) United States Patent
Shigeno et al.

(10) Patent No.: US 6,951,381 B2
(45) Date of Patent: Oct. 4, 2005

(54) INK JET RECORDING APPARATUS

(75) Inventors: Kenji Shigeno, Kanagawa (JP); Yasuo Miyauchi, Tokyo (JP); Hiroyuki Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 10/633,522

(22) Filed: Aug. 5, 2003

(65) Prior Publication Data

US 2004/0041877 A1 Mar. 4, 2004

(30) Foreign Application Priority Data

Aug. 28, 2002 (JP) ..... 2002-248463

(51) Int. Cl.[7] ..... B41J 2/165

(52) U.S. Cl. ..... 347/29; 347/30; 347/32; 347/33

(58) Field of Search ..... 347/22, 23, 29, 347/30, 32, 33, 35

(56) References Cited

U.S. PATENT DOCUMENTS

| | | | | |
|---|---|---|---|---|
| 6,010,203 A | * | 1/2000 | Muraki | 347/30 |
| 6,203,136 B1 | * | 3/2001 | Takahashi et al. | 347/32 |
| 6,629,749 B2 | | 10/2003 | Miyauchi et al. | 347/32 |
| 6,641,250 B2 | | 11/2003 | Saito | 347/31 |
| 6,712,447 B2 | | 3/2004 | Saito | 347/29 |
| 6,722,757 B2 | | 4/2004 | Saito | 347/29 |

FOREIGN PATENT DOCUMENTS

JP 7-108684 4/1995

OTHER PUBLICATIONS

U.S. Appl. No. 10/615.987 (Miyauchi, Y.), filed Jul. 10, 2003 Patented, Patent Number Pending.

* cited by examiner

*Primary Examiner*—Shih-Wen Hsieh
(74) *Attorney, Agent, or Firm*—Fitzpatrick, Cella, Harper & Scinto

(57) ABSTRACT

An ink jet recording apparatus, in which ink is ejected from a recording head to a recording medium to carry out recording, includes a cap which covers an ink ejection port of the recording head, a cap holder which holds the cap, a cap base which rotatably and vertically movably supports the cap holder, and a base member which rotatably supports the cap base. When the cap is separated from the recording head by a predetermined distance, a position of the cap holder is controlled in a state in which the cap holder is oblique at a predetermined angle relative to the cap base so that an abutting plane of the cap is substantially parallel to an ink ejection port surface of the recording head. According to the apparatus, the structure is compact and inexpensive, the cap member can be surely held in close contact with the ejection port surface of the recording head with a constant pressing force, and the ejection port surface can be covered while surely maintaining airtightness.

8 Claims, 15 Drawing Sheets

INK JET RECORDING APPARATUS

BACKGROUND OF THE INVENTION

1. Field of the Invention

The present invention relates to an ink jet recording apparatus in which recording is performed by ejecting ink from recording means to a recording medium.

2. Related Background Art

For the ink jet recording apparatus, in the case that the apparatus is not used for a long period or in the case that a specific ejection port among many ejection ports rarely ejects the ink compared with other ejection ports even if the apparatus is used, due to vaporization of moisture in the ejection port or an ink chamber communicated with the ejection port, viscosity of the ink is increased or the ink is fixed to the ejection port and, as a result, sometimes ejection failure occurs. When an ink droplet, a water droplet, dust, or the like adheres to an ejection port surface of a recording head on which the ejection ports are provided, the ejected ink droplet is pulled by the adhesion material. As a result, sometimes an ejecting direction is deflected. In order to eliminate these problems, an ejecting recovery device (cleaning mechanism portion) including the following recovery processing means for maintaining and recovering ink ejecting performance of the recording head is provided in the ink jet recording apparatus.

For example, a pre-ejecting action which ejects the ink to a predetermined ink receiving portion prior to recording action and removes the ink having the increased viscosity, a sucking recovery action which discharges a foreign material in the ink by sucking the ink from the ejection port or a common ink chamber, an ink suction action for removing a bubble or the like mixed in exchanging ink tanks, an idling suction action for sucking and removing the residual waste ink in a cap, and a capping action which covers the ejection port surface with the cap in order to suppress the vaporization of the ink moisture from the ejection port are carried out as recovery processing action for preventing the ejection failure. A capping mechanism provided in the ejecting recovery device plays an important role in carrying out these actions. For example, the role of a tray for the pre-ejection, in which the ink ejected in the pre-ejecting action is temporarily stored, or the role for holding airtightness, which covers the ejection port surface to seal the ejection port in order to stably carry out the ink suction or the prevention of the vaporization of the ink moisture, can be cited.

For these reasons, a structure in which the capping mechanism is stably in contact with and separated from the ejection port surface has been proposed. For example, the following structure is proposed in Japanese Patent Application Laid-Open No. 07-108684.

That is to say, a capping portion is supported by cap supporting means while the capping portion is freely moved forward and backward relative to the ejection port surface of recording means. The capping portion is freely vertically moved relative to the ejection port surface of the recording means by placing lifting means immediately under the cap supporting means. While the capping portion is energized (or biased) toward a side of the ejection port surface of the recording means by energizing means of a pressurizing spring, the capping portion is formed so as to be maintained substantially parallel to the ejection port surface by positional attitude maintaining means and retreatably rested. The capping mechanism in which the capping portion properly and equally abuts on the ejection port surface of the recording means and is pressed with substantially constant pressing force by the above-described structure is proposed.

According to the capping mechanism having the above-described structure, when the capping portion abuts on the ejection port surface of the recording means, the cap supporting portion oscillatably supports the capping portion. Therefore, the airtightness (sealing properties) of the ejection port covered with the capping portion can be increased, and maintenance and management of the ejection port of the recording means, carried out by the sucking recovery action, can be surely and efficiently performed.

However, the following technical problems to be solved still remain in the structure of the capping mechanism described above.

That is to say, in the technique disclosed in Japanese Patent Application Laid-Open No. 07-108684, a control cam playing the role of the lifting means for freely lifting the capping portion forward and backward is placed immediately under the cap supporting portion. Therefore, though the close contact to and separation from the ejection port surface can be easily carried out, a minimum space for a size of the control cam and a stroke necessary for vertical movement of the cap supporting portion is required for the capping mechanism. As a result, a height of the ejecting recovery device itself is increased and miniaturization of the recording apparatus cannot be realized.

Accordingly, as to a structure in which the size of the device is decreased as much as possible, there is thought of a structure in which the capping portion is lifted in such a manner that a lifting lever or the like is added and the control cam is rotated by applying the principle of leverage. However, in such a structure, though the size of the device can be decreased, the number of parts is increased and cost of a main body of the recording apparatus is increased. Recently, the miniaturization and low-cost of the ink jet recording apparatus are demanded and an inner structure of the general-use recording apparatus satisfying compactness and low cost is required.

SUMMARY OF THE INVENTION

It is an object of the present invention to provide an ink jet recording apparatus, in which the structure is compact and inexpensive, the cap member can be surely held in close contact with the ejection port surface of the recording means with a constant pressing force, and the ejection port surface can be covered while airtightness is surely maintained.

The present invention aims at an ink jet recording apparatus, in which ink is ejected from recording means to a recording medium to carry out recording, including a cap which covers an ink ejection port of the recording means, a cap holder which holds the cap, a cap base which rotatably and vertically movably supports the cap holder, and a base member which rotatably supports the cap base, wherein, when the cap is separated from the recording means by a predetermined distance, a position of the cap holder is controlled in a state in which the cap holder is oblique at a predetermined angle relative to the cap base so that an abutting plane of the cap is substantially parallel to an ink ejection port surface of the recording means.

Further, the present invention aims at an ink jet recording apparatus including a capping mechanism, in which the structure is compact and inexpensive, the cap member can be surely held in close contact with the ejection port surface of the recording means with a constant pressing force, and the ejection port surface can be covered while airtightness is surely maintained.

DESCRIPTION OF THE PREFERRED EMBODIMENTS

Figure 1:
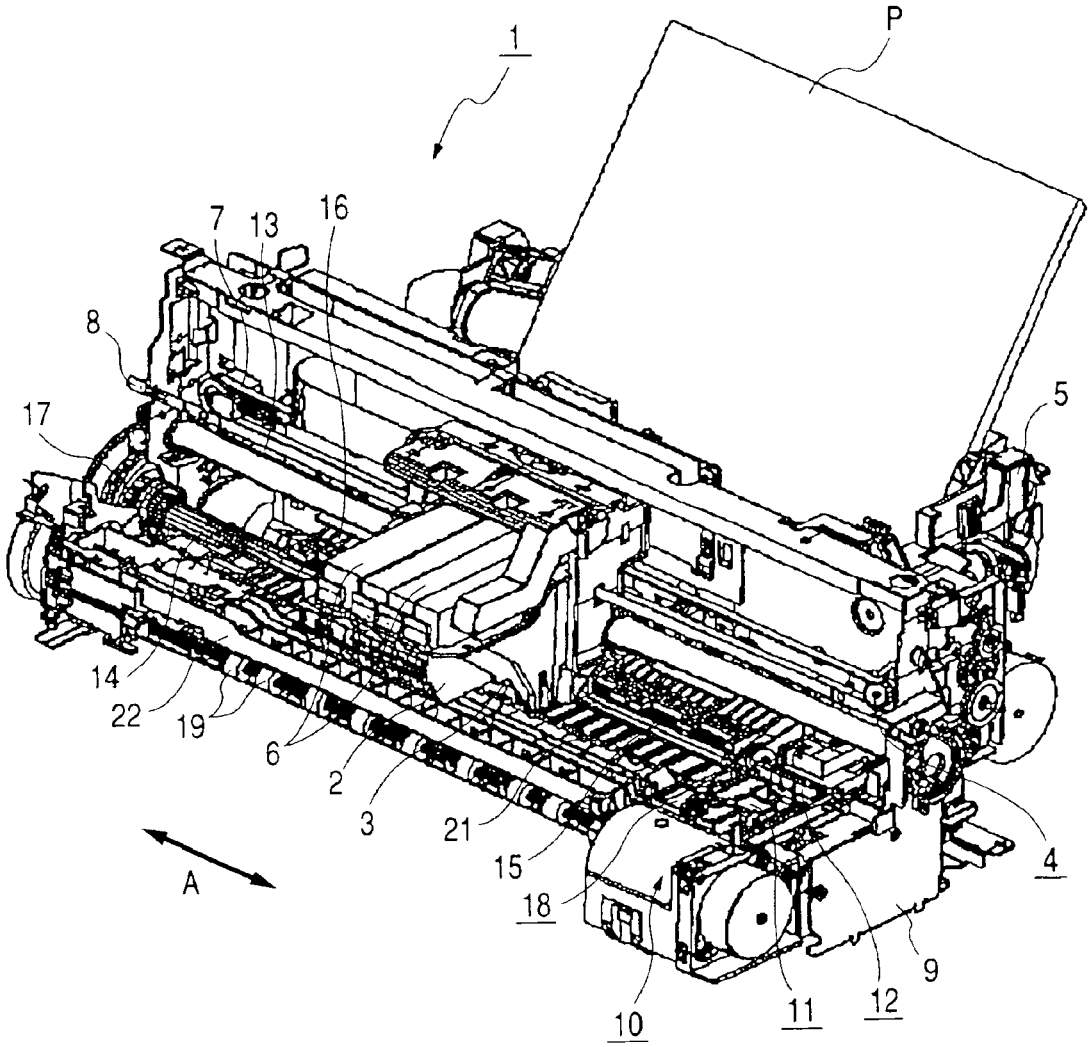
FIG. 1 is a schematic perspective view showing an inner structure of the ink jet recording apparatus having the capping mechanism according to the invention.

Preferred embodiments of the invention will be specifically described below referring to the accompanying drawings. In the drawings, the same reference numerals indicate the same of corresponding parts.

(First Embodiment)

Figure 2:
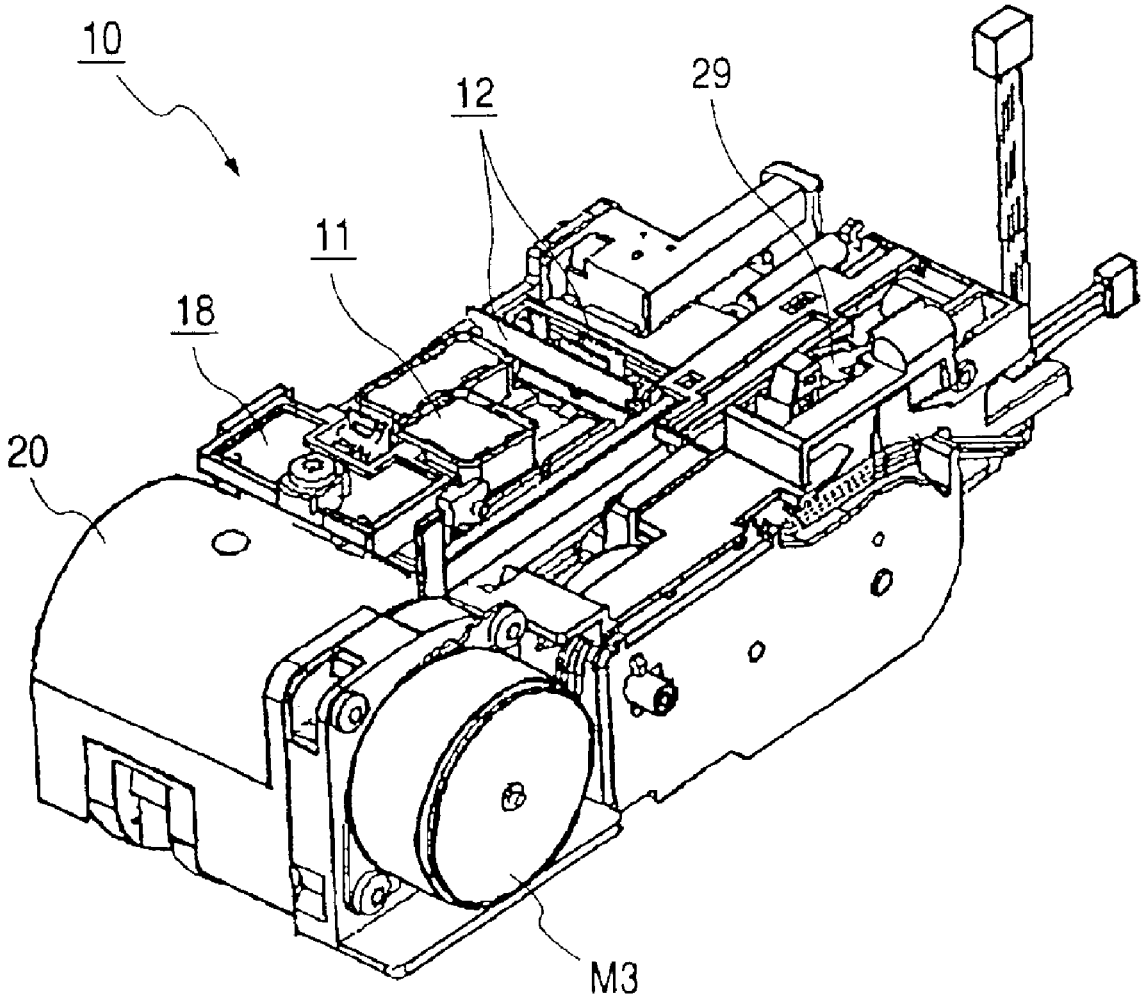
FIG. 2 is a schematic perspective view of the ejecting recovery device in the ink jet recording apparatus of FIG. 1 as seen from the obliquely upper side.
Figure 3:
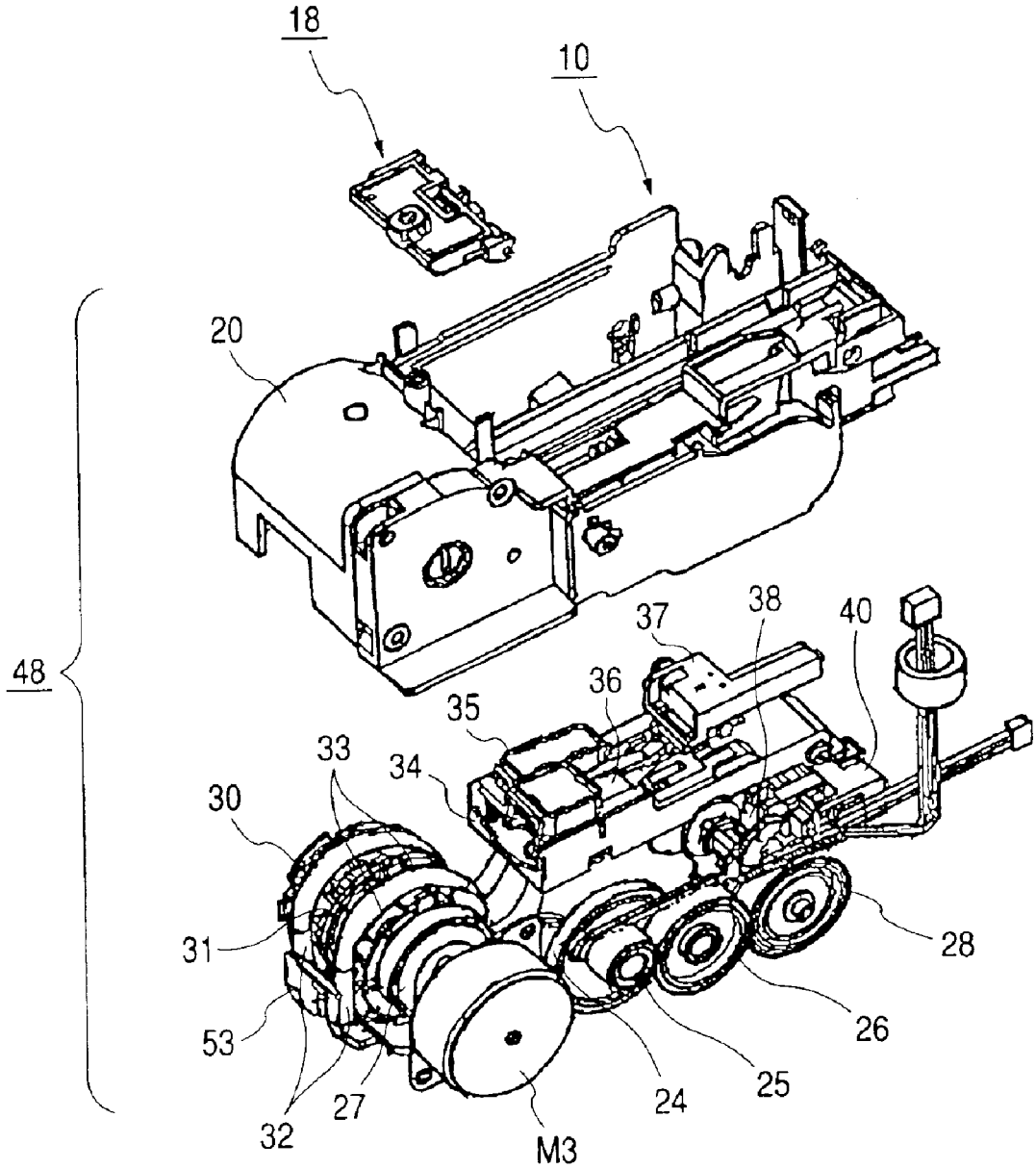
FIG. 3 is a schematically exploded perspective view showing the inner structure of the ejecting recovery device shown in FIG. 2.

FIG. 1 is the schematic perspective view showing the inner structure of the ink jet recording apparatus having the capping mechanism according to the invention, FIG. 2 is the schematic perspective view of the ejecting recovery device in the ink jet recording apparatus of FIG. 1 as seen from the obliquely upper side, and FIG. 3 is the schematically exploded perspective view showing the inner structure of the ejecting recovery device shown in FIG. 2.

In FIGS. 1 to 3, an ink jet recording apparatus 1 includes a carriage motor as a driving source (not shown), a carriage 2 which is equipped with a recording head as the recording means, and a driving mechanism 4 which reciprocates the carrage 2 in a direction of the two-headed arrow A with the carriage motor. The ink jet recording apparatus 1 also includes a paper feeding mechanism 5 which feeds recording paper P as the recording medium to a recording portion, a conveying mechanism having a conveying roller 14 for conveying the fed recording medium P through the recording portion and the like, and an ejecting recovery device 10 (cleaning mechanism portion) which maintains and recovers the ink ejecting performance of the recording head.

In the ink jet recording apparatus 1, the paper feeding mechanism 5 delivers the recording paper P as the recording medium, and the recording head 3 performs the predetermined recording on the recording paper P. An ink cartridge 6 which is an ink storing portion is detachably supported in the carriage 2 in which the recording head 3 is mounted. The ink stored in the ink cartridge 6 is supplied to the recording head 3. In this case, the carriage 2 and the recording head 3 are formed to achieve and maintain required electric contact in such a manner that joint surfaces of both members are in proper contact with each other. The recording head 3 is the ink jet recording head which selectively ejects the ink from the plurality of ejection ports and performs the recording by applying energy according to a recording signal.

The recording head 3 is the ink jet recording means for utilizing thermal energy to eject the ink and including an electrothermal converter for generating the thermal energy. Further, the recording head 3 ejects the ink from the ejection port to perform the recording by utilizing a change in pressure generated by growth and shrinkage of a bubble caused by film boiling, which is generated by the thermal energy applied by the electrothermal converter. In this case, the electrothermal converters are provided corresponding to each ejection port, and the ink is ejected from the corresponding ejection port by applying pulse voltage to the corresponding electrothermal converter according to the recording signal.

Figure 15:
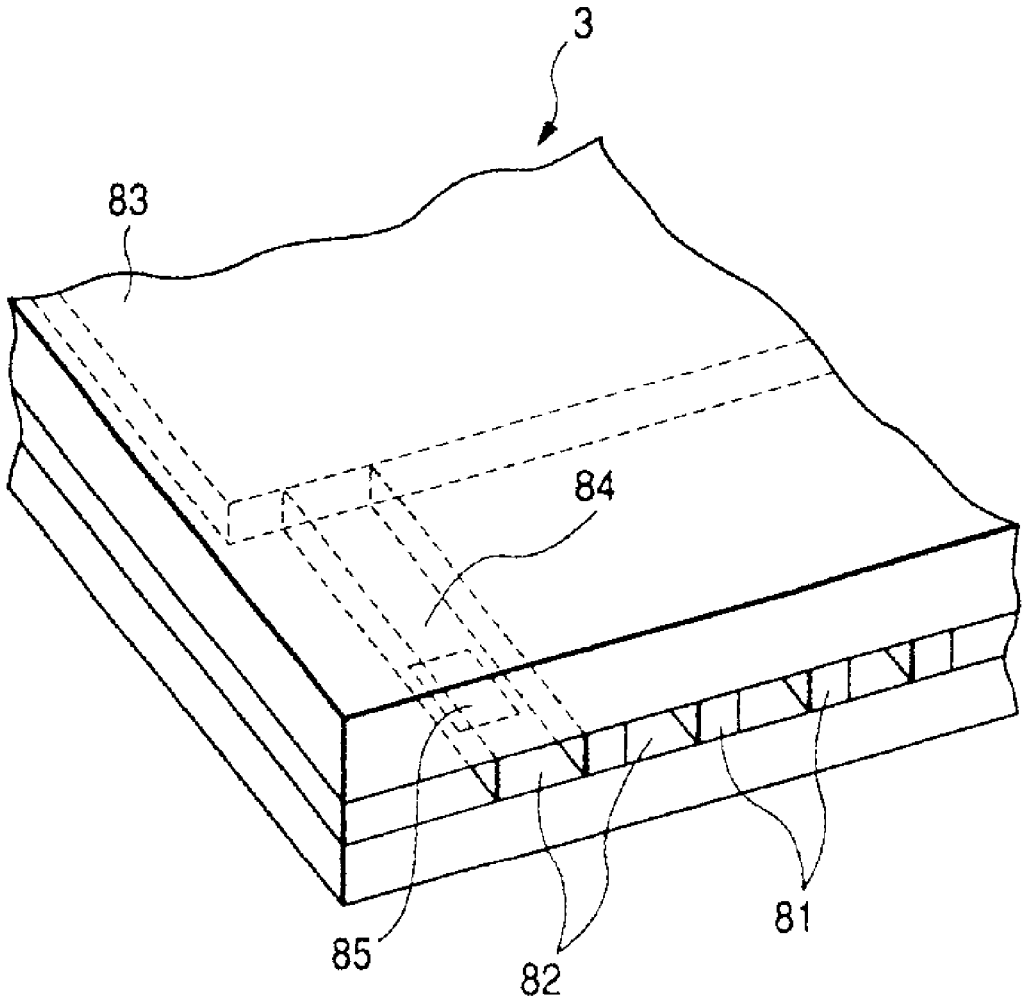
FIG. 15 is a partial perspective view schematically showing the structure of the ink ejecting portion of the recording means shown in FIG. 6.

FIG. 15 is the partial perspective view schematically showing the structure of the ink ejecting portion of the recording means (recording head 3). In FIG. 15, a plurality of ejection ports 82 are formed with a predetermined pitch in an ejection port surface 81 facing the recording medium P (for example, recording paper) with the ejection port surface 81 having a predetermined gap (for example, in the range of about 0.2 mm to about 2.0 mm) from the recording medium P, and an electrothermal converter 85 (for example, electric heating element) which generates the energy for ejecting the ink is provided along a wall surface of each channel 84 which communicates a common liquid chamber 83 with each ejection port 82. The recording head 3 is attached to the carriage 2 so that the ejection ports 82 are arranged in the direction intersecting a main scanning direction (the direction of the arrow A). Thus, the recording means 3 (recording head) is formed such that the corresponding electrothermal converter 85 is driven (energized) on the basis of an image signal or an ejecting signal, the ink in the channel 84 is heated to film boiling, and an ink droplet is ejected from the ejection port 82 by the pressure generated at that time.

In FIG. 1, the carriage 2 is coupled to a driving belt 7 of the driving mechanism 4 which transfers driving force of the carriage motor (not shown) and reciprocated along a guide shaft 13 by normal rotation and reverse rotation of the carriage motor. A scale 8 for detecting a position of the carriage 2 is provided along a moving path of the carriage 2. In the embodiment, the scale 8 is made of a material in which black bars are printed in a transparent PET film with a necessary pitch, one end of the scale 8 is fixed to a chassis 9, and the other end is supported by a leaf spring (not shown). A platen 21 is provided at the position opposite to the ejection port surface 81 of the recording head 3. The recording is performed on the recording medium P conveyed onto the platen 21 by applying the image signal to the recording head at the same time of the main scanning movement of the recording head 3 and ejecting the ink.

In FIG. 1, the reference numeral 14 denotes the conveying roller which is driven by the conveying motor to convey the recording medium P, the reference numeral 15 denotes a pinch roller which is energized by a spring (not shown) toward the conveying roller 14. The reference numeral 16 denotes a pinch roller holder which rotatably supports the pinch roller 15, the reference numeral 17 denotes a conveying roller gear which transfers the driving force of the conveying motor to the conveying roller 14. The recording medium P recorded by the recording head 3 is discharged outside the recording apparatus by a pair of paper discharging rollers which include a paper discharging roller 19 and a spur. A spur holder 22 rotatably supports the spur.

In the ink jet recording apparatus 1, an ejecting recovery device 10 which maintains and recovers the ink ejecting performance of the recording head 3 to the normal condition is provided at the desired position within the moving range but out of the recording area. In FIGS. 1 to 3, the ejecting recovery device 10 includes a capping mechanism 11 which is in close contact with the ejection port surface 81 of the recording head 3 to make the ejection port airtight (capping), wiping means 12 for wiping the ejection port surface 81 of the recording head 3 to clean the ejection port surface 81, and suction means 48 having a suction pump for applying the suction force of the negative pressure at the ejection port through the capping mechanism 11 while the recording head is capped. Suction recovery means for sucking and removing ink having increased viscosity or bubbles in the ejection port can be formed by operating the suction means 48 to suck the ink from the ejection port 82 with the recording head 3 capped. Protection of the recording head 3 can be obtained and drying of the ink can be prevented (suppressed) by capping the ejection port surface 81 with the capping mechanism 11 during non-recording such as during storage of the recording apparatus or during standby. Further, the wiping means eliminates deflection of an ink ejecting direction or ejection failure in such a manner that the wiper rubs against the ejection port surface 81 of the recording head 3 to wipe and remove foreign matter such as ink droplets adhering to the ejection port surface 81, ink fixed to the ejection port surface 81, and dust. The capping mechanism 11, the wiping means 12, and the suction means 48 can maintain the ink ejecting performance of the recording head 3 in the normal state.

In FIGS. 1 to 3, the suction means 48 includes a tube pump which generates the negative pressure in a suction tube 32 arranged along an arc-shaped inner surface of a recovery base 20 (a base portion of the ejection recovery device) as a guide surface, in such a manner that a suction tube 32 (pump tube) is pressed and squeezed by a pressing roller 33 rotatably supported by a pressing roller holder 31 in which rotational drive is carried out about a concentric axis. In the example shown in the figure, two suction tubes 32 are used, and the two suction tubes 32 are supported by a tube guide 53 so as to be positioned along the arc-shaped guide surface.

In the embodiment, each pressing roller 33 is rotatably supported in a rectangular guide hole formed in the pressing roller holder 31 and pressed by a pressing spring (not shown). Each pressing roller 33 performs pump action in such a manner that the rotational drive in one direction of the pressing roller holder 31 presses and squeezes the suction tube 32. Further, each pressing roller 33 acts so as to release the suction tube 32 to communicate with an atmosphere in the rotational drive in the reverse direction of the pressing roller holder 31. The arc-shaped guide surface (guide portion) of the recovery base 20 is formed in the form of a circle, and the two pressing rollers 33 per one suction tube 32 are arranged so that each of the two pressing rollers 33 is located with a difference in rotational angle of about 180°. Accordingly, while one of the pressing rollers 33 retreats, the other pressing roller 33 starts the pressing, so that the suction action can be continuously performed. In the case that the guide surface of the recovery base 20 is substantially formed in the form of the circle, only one pressing roller can perform the same continuous suction action. Further, even in the case that the guide surface (guide portion) is a semi-circle, at least two pressing rollers 33 can perform the same continuous suction action.

A pressing roller holder guide 30 supports the pressing roller holder 31 so that the pressing roller holder 31 can also rotate in a radial direction of the arc-shaped guide portion of the recovery base 20, and the pressing roller holder 31 acts to press and retract the pressing roller 33 relative to the suction tube 32. The pressing roller holder guide 30 is rotatably supported by a bearing of the tube guide 53 through its shafts of both end portions. Further, the pressing roller holder guide 30 is arranged so as to be rotationally driven by obtaining the drive from a PG motor (motor M3) in such a manner that the pressing roller holder guide 30 is rotatably supported about the arc-shaped guide portion of the recovery base 20 as the center of the arc by using a periphery of the bearing of the tube guide 53 as the shaft. The suction recovery action of the suction means 48 (tube pump) is performed in such a manner that the drive from the PG motor M3 rotates the pressing roller holder guide 30 through a PG gear 24 and a pump gear 27. The suction means 48 is formed such that the suction means 48 is directly connected to the rotational drive of the PG motor M3, the suction action is performed in one direction (normal rotation) of the PG motor M3, and the pressing roller 33 is moved in the released (retracted) direction by the rotation in the reverse direction (reverse rotation). Though the motor M3 in the ejecting recovery device 10 drives the suction means 48 in the embodiment, the suction means 48 may be driven by utilizing other driving sources.

Figure 4:
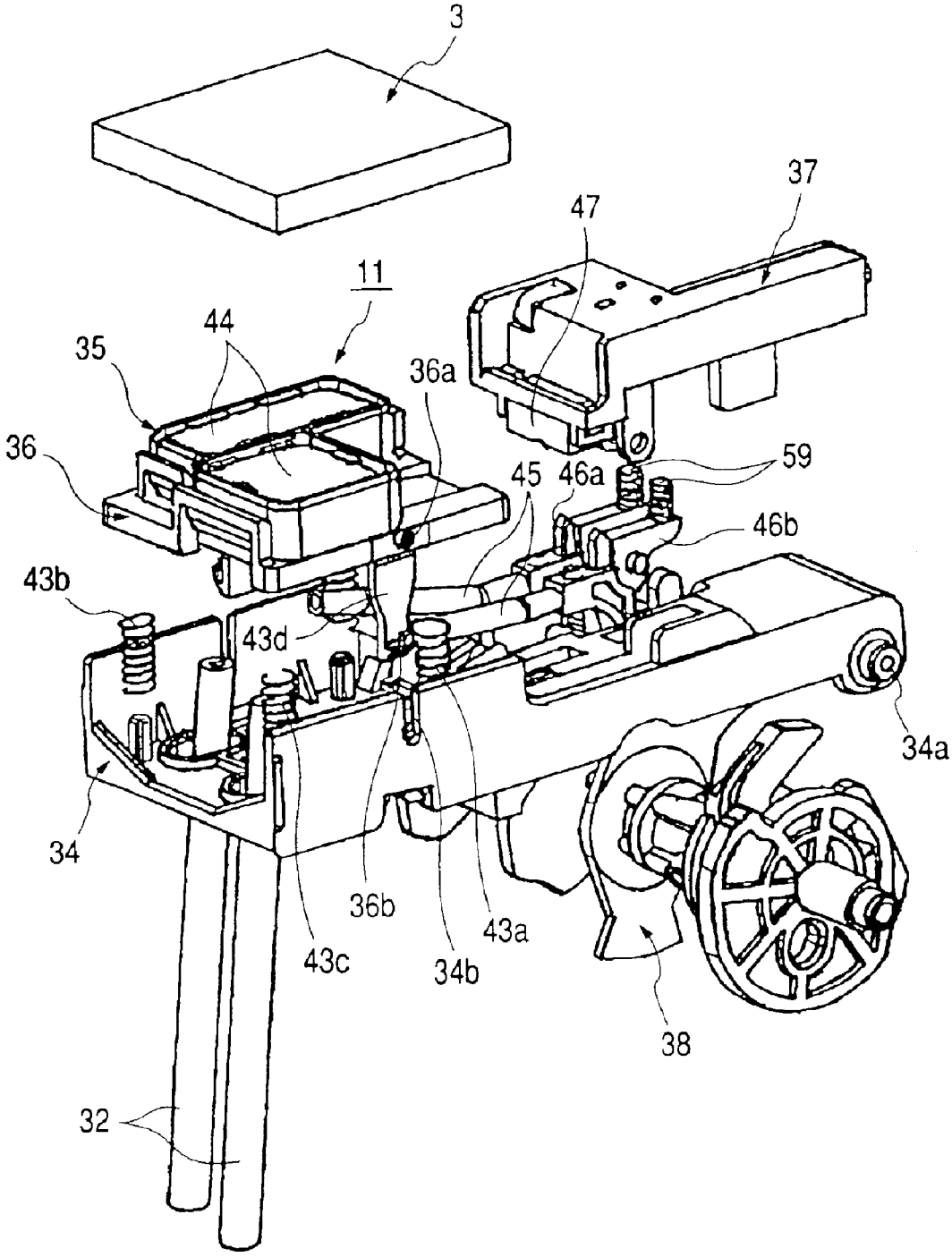
FIG. 4 is an exploded perspective view showing the structure of the capping mechanism of the ejecting recovery device shown in FIGS. 2 and 3.

FIG. 4 is the exploded perspective view showing the structure of the capping mechanism 11 of the ejecting recovery device 10 shown in FIGS. 2 and 3. In FIGS. 2 to 4, the capping mechanism 11 includes a cap 35 abutting on the ejection port surface 81 of the recording head 3, a cap absorber 44 for efficiently absorbing the ink ejected from the ejection port 82 of the recording head 3, a cap holder 36 which can support the cap 35 and press the cap 35 to the ejection port surface 81 with a compression spring 43, and a cap base 34 which supports the compression spring 43 giving capping pressure to the cap holder 36 and supports the cap holder 36 while the cap holder 36 can be slid and rotated in a vertical direction. The cap holder 36 is supported by the plural of compression springs 43 placed between the cap holder 36 and the cap base 34.

The cap base 34 is rotatably supported relative to the recovery base 20 by a cap base rotating support shaft 34*a*. Cap holder rotating support shafts 36*a* provided on both sides are slidably engaged in rotating support shaft sliding grooves 34*b* which are formed in the vertical direction on the both sides of the cap base 34, so that the cap holder 36 can be rotated in forward and backward directions and moved in the vertical direction giving the equal capping pressure with the compression spring 43 during the capping in which the cap 35 abuts on the ejection port surface 81. In the embodiment, the plurality of compression springs 43 are arranged in each corner portion of the cap holder having a substantial quadrangle.

The capping mechanism 11 also includes two atmosphere communicating tubes 45 which are respectively connected to the interior of each of two cap chambers provided in the cap 35 and atmosphere communicating valves 46*a* and 46*b* provided at the other ends of each of the atmosphere communicating tubes 45. These atmosphere communicating valves 46*a* and 46*b* include an on-off (open/close) valve switching each compartment (cap chamber) of the cap 35 between the closed condition and open condition. The two suction tubes 32 communicated to the suction means 48 are connected to a joint portion provided in the cap holder 36 so that action of the suction means 48 applies the negative pressure in the cap 35 while the cap 35 abuts on the ejection port surface 81 and the suction action caused by the negative press allows the suction of the ink from the ejection port 82 of the recording head 3.

Figure 5:
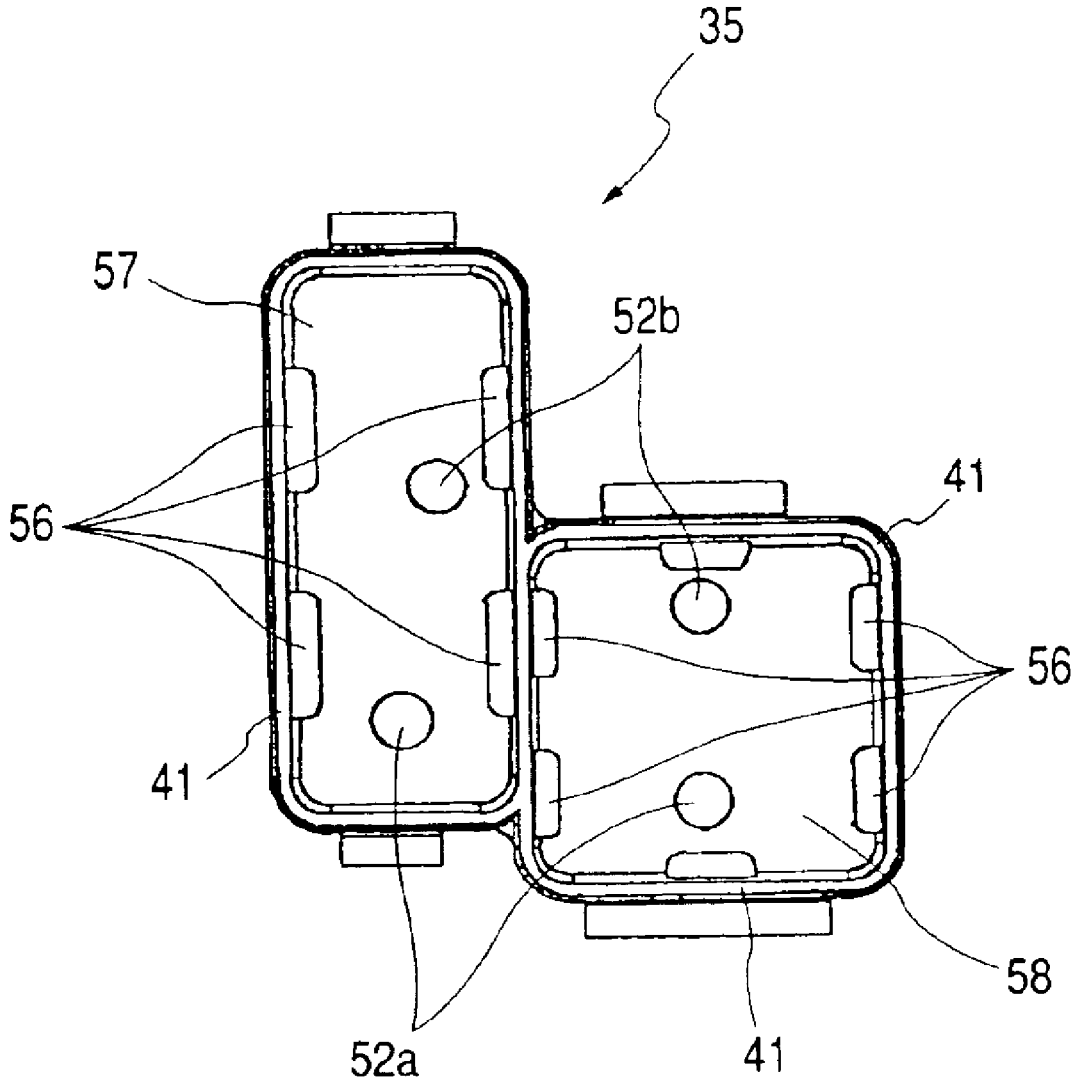
FIG. 5 is a schematic elevation showing the cap of the capping mechanism shown in FIG. 4.
Figure 6:
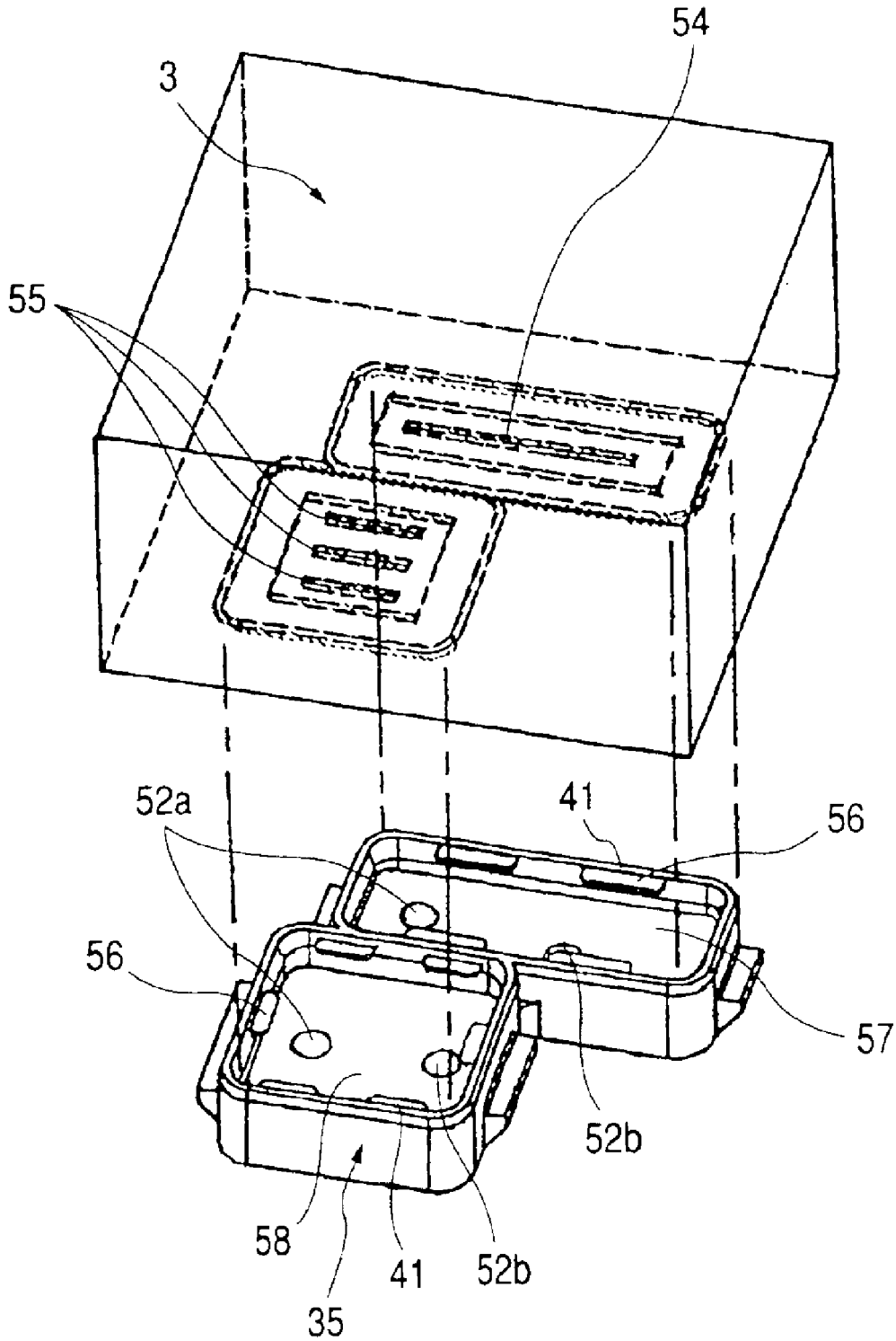
FIG. 6 is a perspective view schematically showing a positional relationship when the cap of the capping mechanism shown in FIG. 4 abuts on the ejection port surface of the recording head.

FIG. 5 is the schematic elevation showing the cap 35 of the capping mechanism 11 shown in FIG. 4 and FIG. 6 is the perspective view schematically showing the positional relationship when the cap 35 of the capping mechanism 11 shown in FIG. 4 abuts on the ejection port surface of the recording head 3. In FIGS. 5 and 6, ejection ports for black ink (line) 54 and ejection ports for color ink (line) 55 are provided in the recording head 3. Corresponding to these ejection ports, the cap 35 is divided into a cap space 57 (cap chamber) dedicated for the black ink and a cap space 58 (cap chamber) dedicated for the color ink. Each of the cap spaces 57 and 58 is filled with the cap absorber 44. The cap absorber 44 is held in each cap space by a cap absorber presser rib 56.

Each of the cap spaces 57 and 58 is individually connected to the suction tube 32 and the atmosphere communicating tube 45 by fitting cap holder fitting holes 52*a* and 52*b* to each joint portion of the cap holder 36. Thus, each of the cap spaces 57 and 58 is formed to be able to cope with the individual suction recovery action. The cap lifting action in which the cap 35 of the capping mechanism 11 abuts on the recording head 3, and the open-close action of the valve levers (atmosphere communicating valve) 46*a* and 46*b* for communicating the inside of the cap 35 (cap spaces 57 and 58) with the atmosphere, are executed by transferring the drive from the PG motor M3 to a one-way clutch 28 through gears 25 and 26. The one-way clutch 28 is fitted to a cam 38 for executing the cap lifting action of the capping mechanism 11 and the open-close action of the valve levers 46*a* and 46*b*, in the same shaft. The one-way clutch acts to transfer the driving force from the PG motor M3 during the rotation in one direction and not to transfer the driving force to the cam 38 by idling during the rotation in the other direction.

The cam 38 is formed to control not only the capping action but also the wiping action of the wiping means 12 and the lifting action of a CR lock lever 29 (FIG. 2). The CR lock lever (carriage lock lever) 29 forms positioning means for controlling a relative position between the recording head 3 and the capping mechanism 11 during the recovery action of the recording head 3. The control of each action of the above-described means such as the capping mechanism 11, the wiping means 12, the suction means 48, and the CR lock lever 29 is executed in such a manner that a flag for a cam position detecting sensor, provided in the cam 38, and a cam position detecting sensor 40 control the positioning of the rotational position of the cam.

The suction action, the wiping action, and the capping action are cited in the actions which are usually executed as maintenance processing (ejecting recovery processing) of the recording head 3 by the ejecting recovery device 10 according to the invention. In particular the capping mechanism 11, in which the cap 35 can stably abut on the ejection port surface 81 of the recording head 3 to form the closed space, is required in order to stably execute the suction action. In the embodiment of the invention, in order to realize the capping mechanism 11 for providing the compact, low-cost ink jet recording apparatus which can stably abut on the recording head 3 in which the ejection port line 54 for the black ink and the ejection port line 55 for the color ink are densely formed in small space as shown in FIGS. 5 and 6, the structure described below is adopted.

Figure 7:
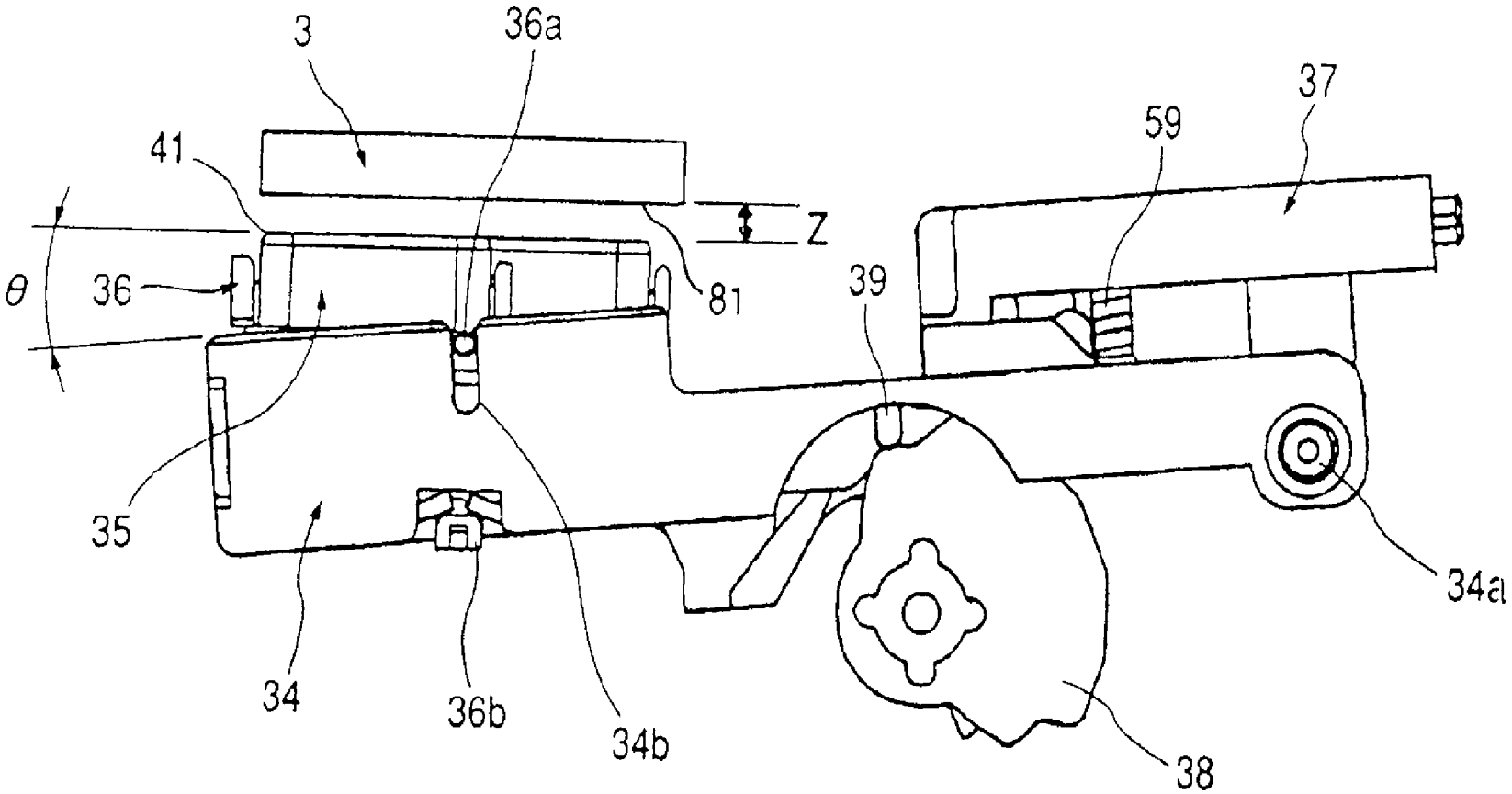
FIG. 7 is a schematic side view showing the positional relationship between the recording means and the capping mechanism in a pre-ejecting position of the capping mechanism according to the invention.
Figure 8:
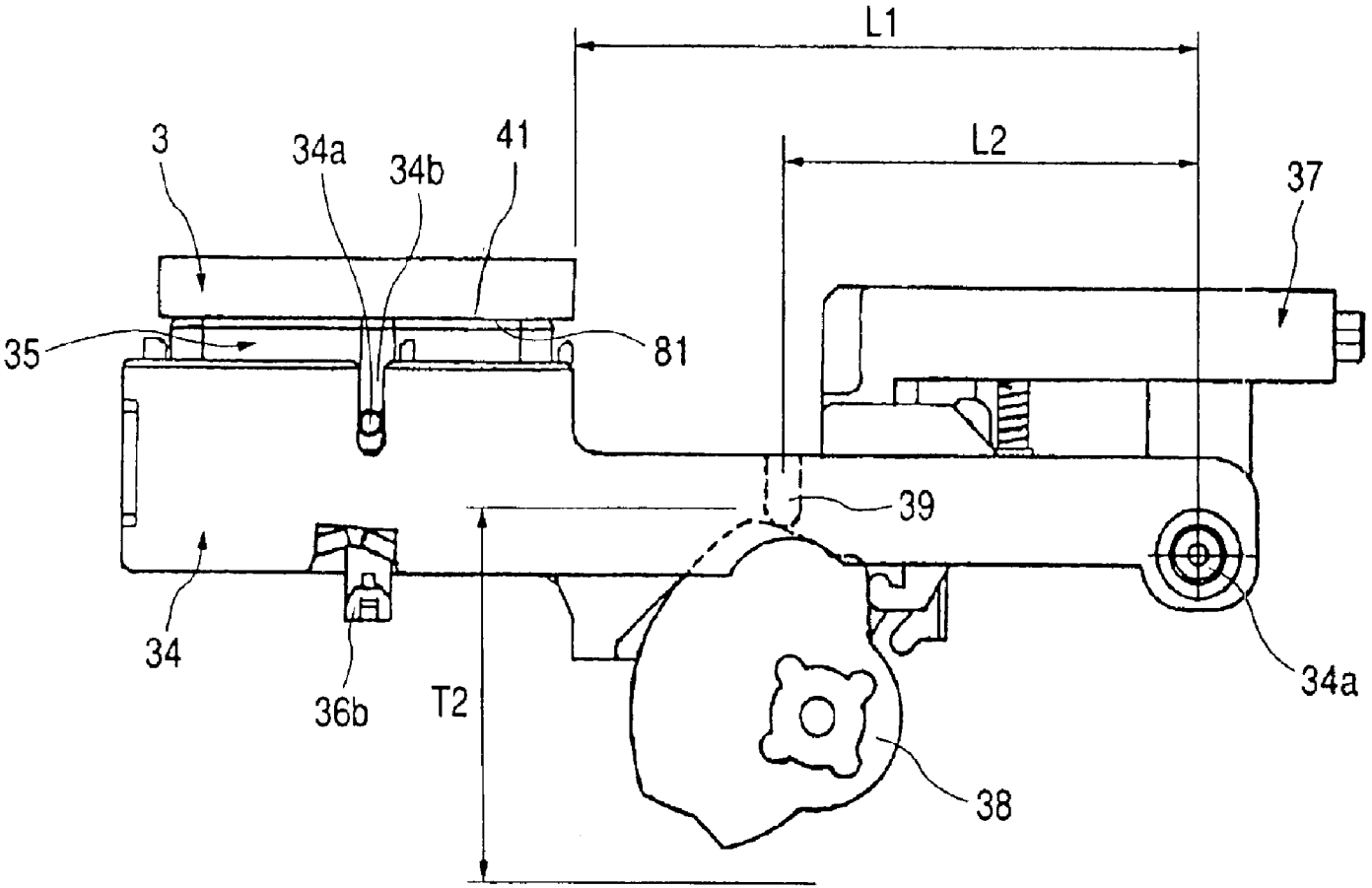
FIG. 8 is a schematic side view showing the positional relationship between the recording means and the capping mechanism in a cap-closed position of the capping mechanism shown in FIG. 7.
Figure 9:
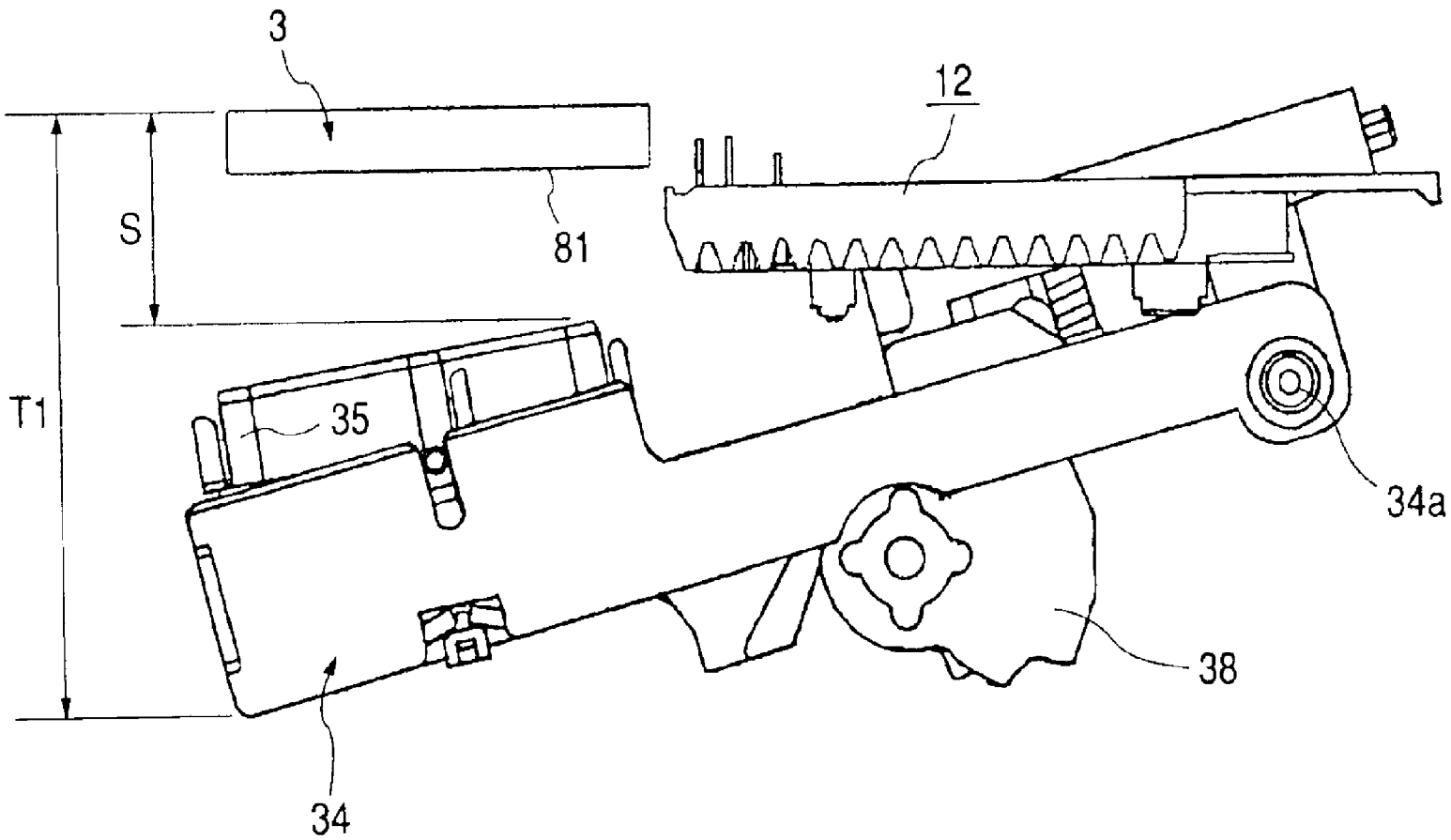
FIG. 9 is a schematic side view showing the positional relationship among the recording means, the wiping means, and the capping mechanism in a retracting position of the capping mechanism shown in FIGS. 7 and 8.
Figure 10B:
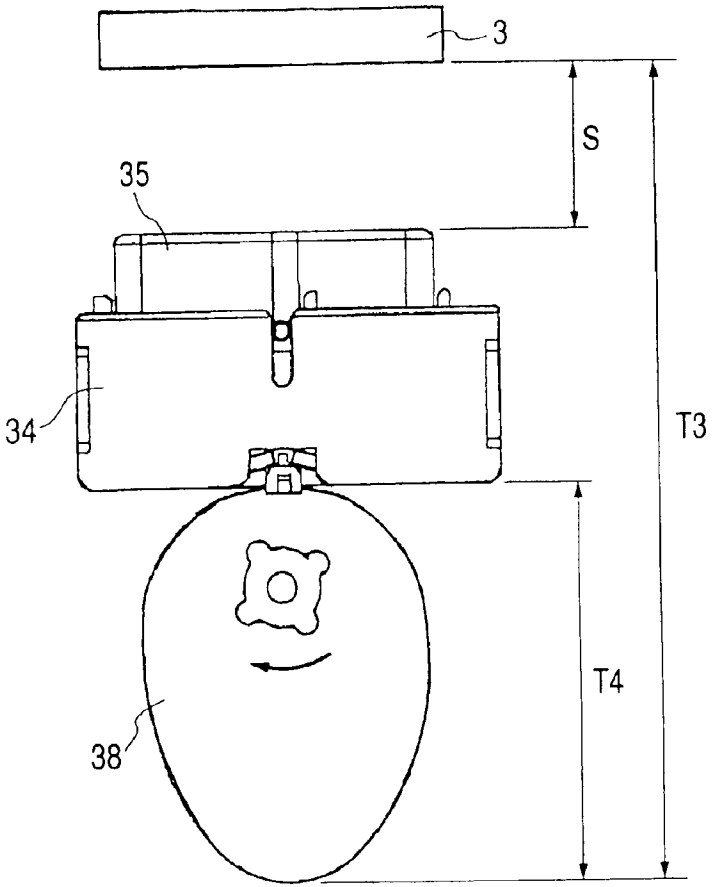
FIG. 10A is a schematic side view showing the cap-closed state of the usual capping mechanism and FIG. 10B is a schematic side view showing the retracting position of the usual capping mechanism.
Figure 10A:
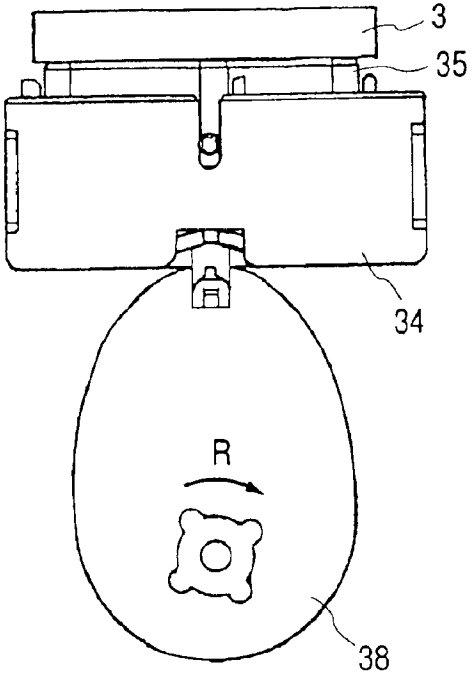
Figure 11A:
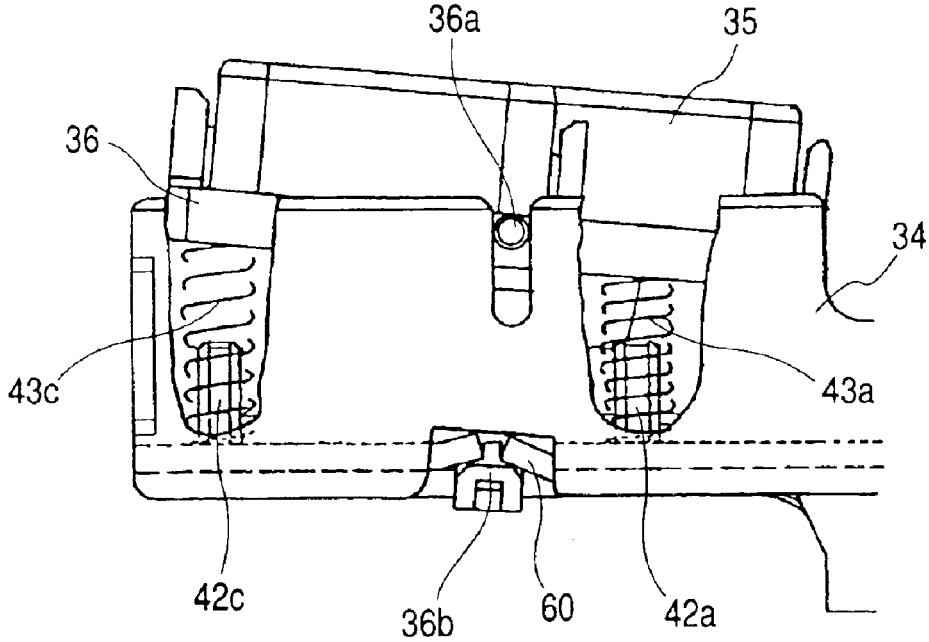
FIG. 11A a schematic side view showing a capping pressure released state of a capping portion according to the invention and FIG. 11B a schematic side view showing a capping pressure generating state of the capping portion of the capping mechanism according to the invention.
Figure 11B:
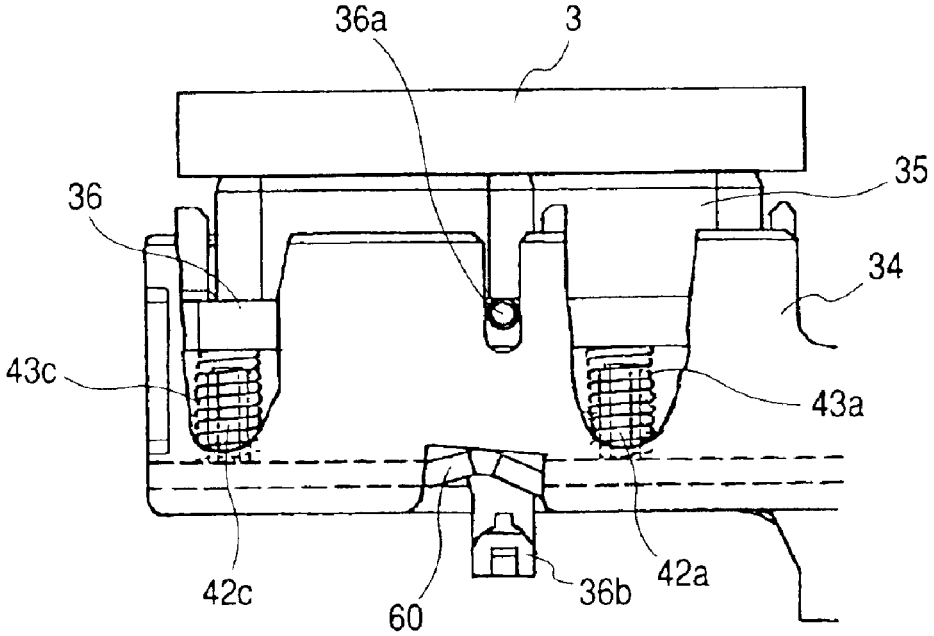
Figure 12:
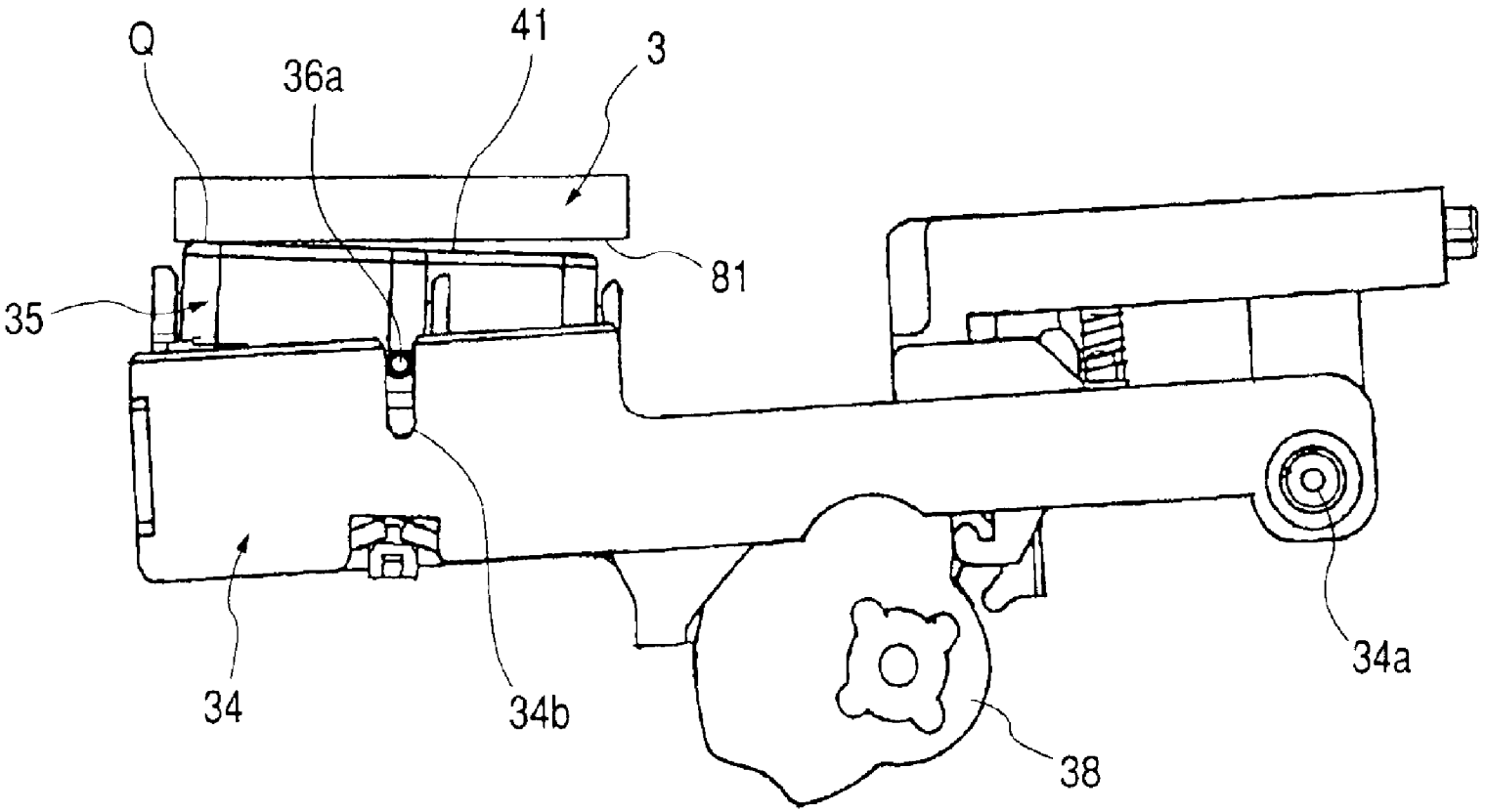
FIG. 12 is a schematic side view showing the state in which the capping mechanism shown in FIGS. 7 and 8 starts to abut on the recording head.

FIG. 7 is the schematic side view showing the positional relationship between the recording means and the capping mechanism in the pre-ejecting position of the capping mechanism according to the invention, FIG. 8 is the schematic side view showing the positional relationship between the recording means and the capping mechanism in the cap-closed position of the capping mechanism shown in FIG. 7, FIG. 9 is the schematic side view showing the positional relationship among the recording means, the wiping means, and the capping mechanism in the retracting position of the capping mechanism shown in FIGS. 7 and 8, FIGS. 10A and 10B are the schematic side views showing the cap-closed state and the retracting position of the usual capping mechanism respectively, FIGS. 11A and 11B are the schematic side views showing the capping pressure released state of the capping portion and the capping pressure generating state of the capping portion of the capping mechanism according to the invention, and FIG. 12 is the schematic side view showing the state in which the capping mechanism shown in FIGS. 7 and 8 starts to abut on the recording head.

In the capping mechanism 11 shown in FIGS. 7 to 9 and 12, the cap 35 is formed to come into close contact with and be separated from the ejection port surface 81 of the recording head 3 by rotating the cap base 34 about the cap base rotating support shaft 34*a*. When the cam 38 is rotated in one direction, a cam surface of the cam 38 abuts on a cam acting boss 39 of the cap base 34 and a stop position of the cam 38 determines a rest position of the cap base 34, which determines each position of the capping mechanism 11.

As shown in FIGS. 8 and 9, according to the positional relationship between the cap base rotating support shaft 34*a* and the cam acting boss 39 of the cap base 34 and the positional relationship of the cam 38 in the capping mechanism 11 of the embodiment, a distance (L1) from the cap base rotating support shaft 34*a* to the cap rib 41 is longer than a distance (L2) from the cap base rotating support shaft 34*a* to the cam acting boss 39. Therefore, in order to move the cap 35 by a retracting stroke (S), an outer diameter (T2) of the cam 38 can be decreased in proportion to L2/L1, as compared to the outer diameter necessary to the case of the structure in which the cam 38 is located directly under the cap 35 as shown in FIGS. 10A and 10B. As the distance (L2) is decreased as much as possible and the distance (L1) is increased as much as possible, the outer diameter (T2) can be decreased significantly.

On the other hand, in the capping mechanism, shown in FIGS. 10A and 10B, to which the present invention is not applied, since the cam 38 is provided directly under the cap 35, in order to move the cap 35 by the same distance as the retracting stroke (S) in FIG. 9 relative to the recording head 3, it is necessary that an outer diameter (T4) of the cam 38 is set to a value according to an absolute value of the retracting stroke (S) and it is necessary that the outer diameter (T4) of the cam 38 is formed to be much larger than the outer diameter (T2) in FIG. 8. In other words, the relationship between T2 and T4 approximately has the difference of a ratio of L2 to L1 shown in FIG. 8. In the structure of the embodiment shown in FIGS. 7 to 9 and 12, the size of the cam 38 is decreased and the height of the capping mechanism 11 is decreased, so that the miniaturization of the capping mechanism can be realized.

That is to say, in the structure shown in FIGS. 10A and 10B, since the cam 38 controlling the lifting action of the cap 35 is placed directly under the cap base 34 (cap 35), the height of the ejecting recovery device 10 directly depends on the size of the cam 38 and it is necessary that the retracting stroke (S) of the cap 35 is also largely increased corresponding to the size of the cam 38 as shown by a height (T3) in FIGS. 10A and 10B. On the contrary, according to the structure of the embodiment, the cam 38 avoids being placed directly under the area where the cap 35 is vertically moved and the cam 38 is placed directly under the space different from the area where the cap 35 is vertically moved, so that a height (T1) of the ejecting recovery device 10 can be remarkably decreased compared with the height (T3) of the case shown in FIGS. 10A and 10B.

According to the embodiment, in executing the pre-ejecting action, the cap 35 can be held at the position where the cap 35 is equally separated from the ejection port surface 81 of the recording means 3 by a constant distance Z while the cap 35 is rested parallel to the ejection port surface 81. Accordingly, the ink ejected from the ejection port 82 by the pre-ejection is securely received by the cap 35 and the received ink can be held in the cap 35 without dropping the ink inside the main body of the apparatus.

The cap base 34 is rested at the rest position of the cap base 34 in the pre-ejecting position shown in FIG. 7 while the cap base 34 is oblique relative to the ejection port surface 81 of the recording means 3 (position of angle θ in FIG. 7). According to the structure, the cap base 34 is rotated about the support shaft 34*a* by the relative angle between the cap 35 and the cap base 34 from the rest position of the cap base 34 in the pre-ejecting position shown in FIG. 7. Accordingly, when the cap 35 abuts (close contact) on the ejection port surface 81 to become the cap-closed state shown in FIG. 8, a bottom surface of the cap base 34 can be formed to be parallel to the ejection port surface 81 of the recording head 3 as shown in FIG. 11B and cap pressing force (capping pressure) can equally act by energizing the cap holder 36.

As described above, in the structure of the capping mechanism 11 of the embodiment, when the cap 35 is rested at the pre-ejecting position (FIG. 7), the distance (Z) between a plane of the cap rib 41 (cap sealing plane or cap abutting plane) of the cap 35 and ejection port surface 81 of the recording head 3 is held at proper distance. Since the cap holder 36 holding the cap 35 is obliquely rested at the relative angle θ to the cap base 34 so that the cap 35 is rested parallel to the ejection port surface 81, a hook portion (pawl portion) 36*b* of the cap holder 36 can engage a cap holder attitude controlling portion 60 of the cap base 34 as shown in FIG. 11A and the cap holder 36 can be rested at the oblique position of the angle θ relative to the cap base 34.

It is preferable that the gap Z (FIG. 7) between the ejection port surface 81 of the recording means 3 and the cap 35 in the embodiment is set to a distance such that splashing of the ink from the cap 35 to the ejection port surface 81 is reduced during the pre-ejection and floating of ink mist, generated during the pre-ejection, in the main body of the apparatus is reduced. The gap Z is selected to be about 2.5 mm in the embodiment.

The structure and the mechanism, in which the cap 35 stably comes into close contact with the ejection port surface 81 of the recording means 3, will be described below referring to FIG. 12. FIG. 12 shows the state in which the cap 35 starts to abut on the ejection port surface 81. In changing the state from the state shown in FIG. 12 to the cap-closed state (capped state) shown in FIG. 8, while the plane of the cap rib 41 of the cap 35 gives the capping pressure to the ejection port surface 81, the plane of the cap rib 41 gradually increases a degree of the contact from a region Q initially abutting on the ejection port surface 81 as a base point by the rotation of the cap base 34 caused by the rotation of the cam 38.

At that point, according to the structure of the capping mechanism 11 of the embodiment, the cap holder 36 compresses the compression spring 43 to increase the capping pressure by the rotating action of the cap base 34 about the rotating support shaft 34*a*, which allows the cap holder 36 to be released from controlling force of the cap base 34. At the same time, the cap holder rotating support shaft sliding groove 34*b* formed in the cap base 34 is moved on the arc whose center is the cap base rotating support shaft 34*a* by the rotating action of the cap base 34 around the rotating support shaft 34*a*. Subsequently, the cap holder rotating support shaft 36*a* has an orbit similar to that of the sliding groove 34*b*.

Therefore, in the abutting action of the cap 35 on the ejection port surface 81, the rotational movement of the cap 35 is generated by using, as a fulcrum, the region (edge rib) Q, where the cap rib 41 initially abuts on the ejection port surface 81, so that relative shift between the cap rib 41 and the ejection port surface 81 never occurs during the time from the abutment of the plane of the cap rib 41 (cap sealing plane) on the ejection port surface 81 at the abutting start region Q to the completely close contact of the whole plane of the cap rib 41 to the ejection port surface 81. As a result, the cap 35 can be gradually pressed to the ejection port surface 81 in a stable state and a stable capping action can be realized.

(Second Embodiment)

Figure 13:
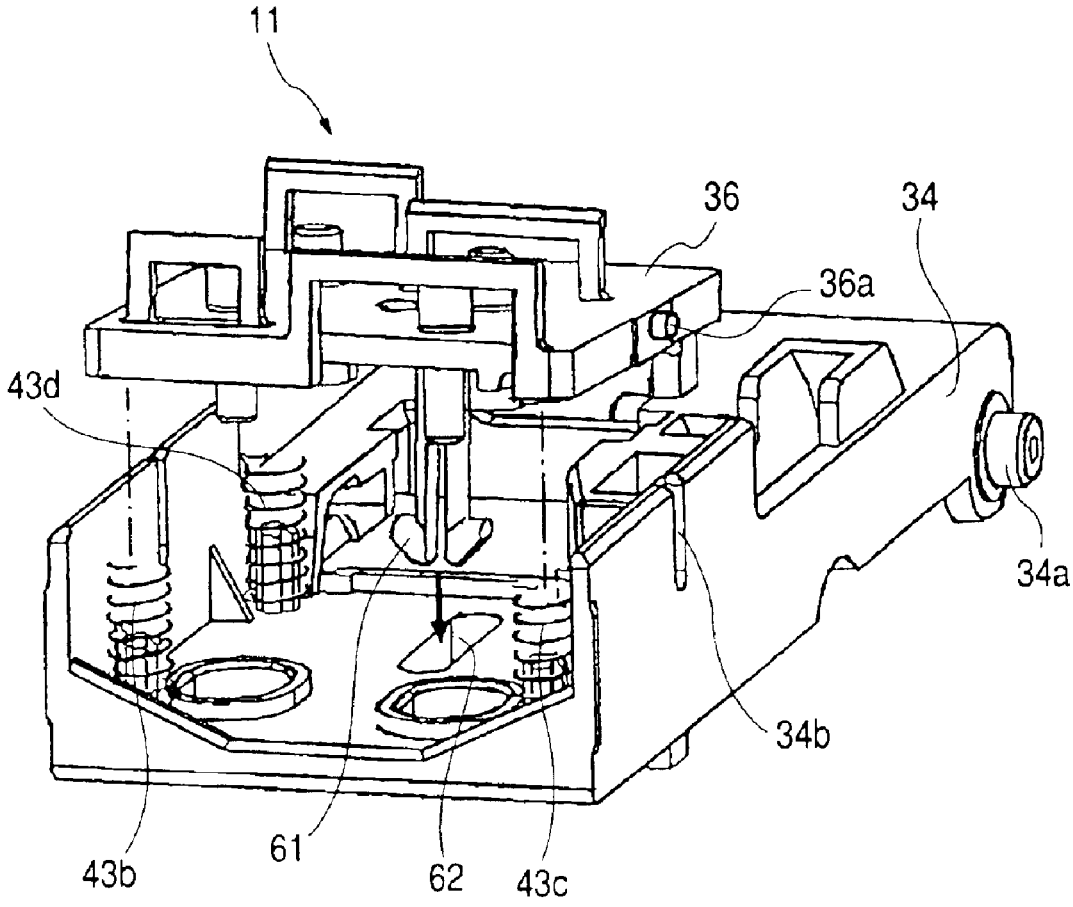
FIG. 13 is a schematically exploded perspective view showing the capping mechanism according to a second embodiment of the invention.
Figure 14A:
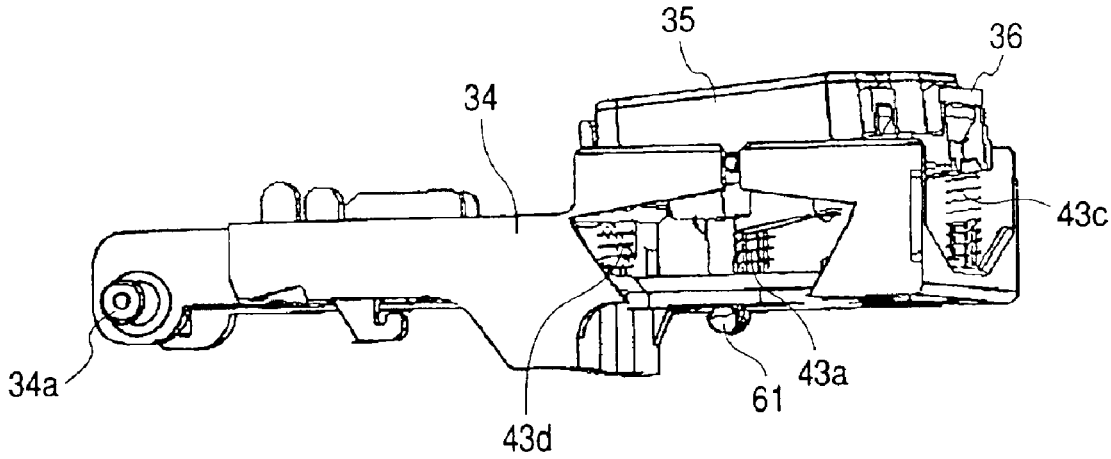
FIG. 14A is a perspective view of the side face of the capping mechanism shown in FIG. 13
Figure 14B:
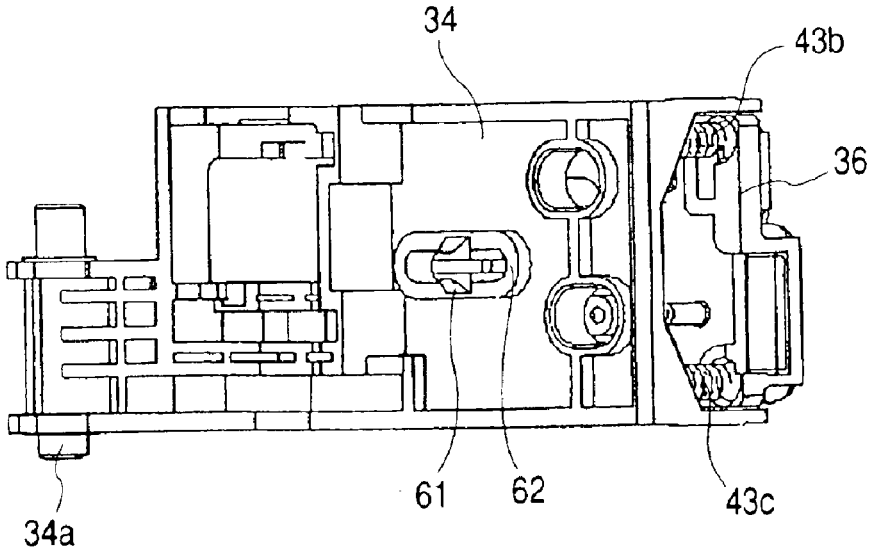
FIG. 14B is a perspective view of the bottom of the capping mechanism shown in FIG. 13.

FIG. 13 is the schematically exploded perspective view showing the capping mechanism 11 according to a second embodiment of the invention, FIG. 14A is the perspective view of the side face of the capping mechanism shown in FIG. 13, and FIG. 14B is the perspective view of the bottom of the capping mechanism shown in FIG. 13.

In the second embodiment shown in FIGS. 13, 14A and 14B, a cap holder attitude controlling hole 62 is provided in the substantial center portion of the cap base 34 and a cap holder attitude controlling pawl 61 extending downward from the cap holder 36 is fitted into the cap holder attitude controlling hole 62 by way of the structure for controlling the attitude of the cap holder 36 to the cap base 34. Similarly to the first embodiment, the second embodiment has the structure which allows the cap holder 36 to obliquely control at a predetermined amount (predetermined angle) relative to cap base 34. Though the second embodiment shown in FIGS. 13, 14A, and 14B differs from the first embodiment in the above-described points, the second embodiment substantially has the same structure as the first embodiment in other points.

According to the embodiment having the above-described structure, the capping mechanism 11 is compact and inexpensive, the cap member 35 can be surely held in close contact with the ejection port surface 81 of the recording means (recording head) 3 with a constant and equal pressing force, and the ejection port surface 81 can be covered while surely maintaining airtightness, and an ink jet recording apparatus which utilizes the recovery device 10 having the capping mechanism 11 can be obtained.

In the embodiment described above, the capping mechanism 11 including the cap 35 having the plurality (two) of spaces has been described as the example. However, the invention can be also applied to the capping mechanism including the cap having only one space or at least three spaces, the same effect can be obtained, and the invention can include those capping mechanisms.

The ink jet recording apparatus having a serial recording operation in which the recording means 3 is moved relatively to the recording medium P has been described as the example. However, the invention can be also applied to the ink jet recording apparatus having a line recording operation in which the recording is carried out only with a sub-scan by using a line head type of recording means having a length covering a whole width or a part of the width of the recording medium P, and the same effects can be achieved.

The invention can be also applied to a recording apparatus having one recording means, a color recording apparatus which utilizes a plurality of recording means carrying out the recording with a plurality of color inks, a gray-scale recording apparatus which utilizes a plurality of recording means carrying out the recording in the same color with different densities, or a recording apparatus combining those recording apparatuses, and the same effects can be achieved.

Further, the invention can be also applied to any case of the arrangement and structure of the recording head and an ink tank, such as the structure using the changeable ink cartridge in which the recording head and the ink tank are integrally formed or the structure in which the recording head and the ink tank are individually formed and connected with an ink supply tube, and the same effect can be obtained.

The invention can be also applied to the case in which the ink jet recording apparatus uses recording means utilizing, for example, an electro-mechanical converter such as a piezoelectric element. However, particularly the invention can obtain excellent effects for the ink jet recording apparatus using the recording means in which the ink is ejected by utilizing thermal energy. This is because the method utilizing thermal energy can achieve high-density recording and fine recording.

What is claimed is:

1. An ink jet recording apparatus in which ink is ejected from recording means to a recording medium to carry out recording, comprising:

a cap which covers an ink ejection port of the recording means;

a cap holder which holds the cap;

a cap base which rotatably and vertically movably supports the cap holder; and a base member which rotatably supports the cap base, wherein, when the cap is separated from the recording means by a predetermined distance, a position of the cap holder is controlled in a state in which the cap holder is oblique at a predetermined angle relative to the cap base so that abutting plane of the cap is substantially parallel to an ink ejection port surface of the recording means.

2. An ink jet recording apparatus according to claim 1, wherein a compression spring for applying capping pressure of the cap is provided between the cap holder and the cap base.

3. An ink jet recording apparatus according to claim 2, further comprising plural compressions springs, wherein the compression springs are provided at a plurality of positions of the cap holder, and a supporting surface which supports the compression springs of the cap base is parallel to the ink ejection port surface when the cap abuts on the ink ejection port surface.

4. An ink jet recording apparatus according to claim 1, wherein, when the cap abuts on the ink ejection port surface, the abutment is started from an end portion of a cap rib surface of the cap, an abutting range is gradually increased, and the whole surface of the cap rib surface abuts on the ink ejection port surface.

5. An ink jet recording apparatus according to claim 1, wherein when the cap abuts on the ink ejection port surface, the abutment is started from an end portion of the cap rib surface of the cap and the whole surface of the cap rib surface abuts on ink ejection port surface in such a manner that the cap and the cap holder are rotated around an abutting start portion as a center.

6. An ink jet recording apparatus according to claim 1, wherein a rotational position of the cap base is controlled by a rotating cam provided below the cap base.

7. An ink jet recording apparatus according to claim 6, wherein a distance between a rotational center of the cap base and a rotational center of the rotating cam is smaller than the distance between the rotational center of the cap base and the cap holder.

8. An ink jet recording apparatus according to claim 1, wherein, shaft portions provided on both sides of the cap holder are slidably engaged with groove portions provided in the cap base.

* * * * *